US011437228B2

(12) United States Patent
Inoue

(10) Patent No.: US 11,437,228 B2
(45) Date of Patent: Sep. 6, 2022

(54) MERCURY DISCHARGE LAMP

(71) Applicant: PHOTOSCIENCE JAPAN CORPORATION, Tokyo (JP)

(72) Inventor: Akihiro Inoue, Chigasaki (JP)

(73) Assignee: PHOTOSCIENCE JAPAN CORPORATION, Tokyo (JP)

( * ) Notice: Subject to any disclaimer, the term of this patent is extended or adjusted under 35 U.S.C. 154(b) by 0 days.

(21) Appl. No.: 17/415,163

(22) PCT Filed: Jan. 21, 2020

(86) PCT No.: PCT/JP2020/001970
§ 371 (c)(1),
(2) Date: Jun. 17, 2021

(87) PCT Pub. No.: WO2020/153365
PCT Pub. Date: Jul. 30, 2020

(65) Prior Publication Data

US 2022/0059339 A1 Feb. 24, 2022

(30) Foreign Application Priority Data

Jan. 25, 2019 (JP) ..... JP2019-011334

(51) Int. Cl.
*H01J 61/60* (2006.01)
*H01J 61/28* (2006.01)
*H01J 61/52* (2006.01)

(52) U.S. Cl.
CPC ..... *H01J 61/60* (2013.01); *H01J 61/28* (2013.01); *H01J 61/52* (2013.01)

(58) Field of Classification Search
CPC ..... H01J 61/60; H01J 61/28; H01J 61/52
See application file for complete search history.

(56) References Cited

U.S. PATENT DOCUMENTS 3,634,717 A * 1/1972 Boucher ..... H01J 61/72 313/552
3,859,555 A * 1/1975 Latassa ..... H01J 61/72 313/547

FOREIGN PATENT DOCUMENTS

JP S6147056 A 3/1986
JP H03266352 A 11/1991
(Continued)

OTHER PUBLICATIONS

Washimi. "Control of Mercury Vapor Pressure of Fluorescent Lamps by Indium-Mercury Amalgam." Journal of the Illuminating Engineering Institute of Japan. 1969: 442-449. vol. 53, No. 8. Cited in Specification. English abstract provided.
(Continued)

*Primary Examiner* — Anne M Hines
(74) *Attorney, Agent, or Firm* — Rossi, Kimms & McDowell LLP

(57) ABSTRACT

A mercury discharge lamp includes: a discharge tube having encapsulated therein mercury in the form of an amalgam; and a temperature control member that controls an ambient temperature of the amalgam in such a manner as to compensate for a change in the ambient temperature of the amalgam. The temperature control member may include a bimetal supporting the amalgam at a predetermined position, and the support member is formed or constituted by a bimetal. By the bimetal deforming in response to a change in the ambient temperature of the amalgam, the temperature control member changes a spaced-apart distance of the amalgam to a filament within the discharge tube and thereby changes an influence of heat generation by the filament on the amalgam. The temperature control member may include, near the amalgam, a resistance element whose resistance
(Continued)

value changes in response to a temperature to control heat generation thereby.

12 Claims, 2 Drawing Sheets

(56) References Cited

FOREIGN PATENT DOCUMENTS

| | | | |
|---|---|---|---|
| JP | H1074488 | A | 3/1998 |
| JP | 2003346712 | A | 12/2003 |
| JP | 2006079910 | A | 3/2006 |
| JP | 2009266759 | A | 11/2009 |

OTHER PUBLICATIONS

International Search Report issued in Intl. Appln. No. PCT/JP2020/001970 dated Mar. 17, 2020. English translation provided.
Written Opinion issued in Intl. Appln. No. PCT/JP2020/001970 dated Mar. 17, 2020.
English translation of Written Opinion issued in Intl. Appln. No. PCT/JP2020/001970 dated Mar. 17, 2020, previously cited in IDS filed Jun. 17, 2021.
International Preliminary Report on Patentability issued in Intl. Appln. No. PCT/JP2020/001970 dated Aug. 5, 2021. English translation provided.

* cited by examiner

MERCURY DISCHARGE LAMP

TECHNICAL FIELD

The present invention relates generally to mercury discharge lamps having encapsulated therein mercury in an amalgam form, and more particularly to a mercury discharge lamp provided with a function for controlling an amalgam temperature.

BACKGROUND

Ultraviolet rays of a short wavelength range are used today for sterilization, decomposition of toxic organic substances, and the like, and low-pressure mercury vapor discharge lamps have heretofore been known as sources for generating ultraviolet rays having a wavelength of 185 nm, 254 nm, or the like. Generally, the low-pressure mercury vapor discharge lamp has encapsulated therein a rare gas, such as argon (Ar), along with a superfluous amount of mercury, and vapor pressure (vaporization amount) of the mercury changes depending on a temperature of the coldest portion within the discharge lamp. Further, radiation efficiency of the ultraviolet rays and the like in the discharge lamp is closely related with the mercury vapor pressure. Furthermore, for enhancing a processing capability, high densification of the discharge lamp has been done, and there has been employed an approach of encapsulating the mercury in an amalgam form. Namely, this approach includes alloying (amalgamating) the mercury with other metals, such as bismuth (Bi), tin (Sn), and indium (In), and placing the resultant alloy within the discharge lamp to thereby suppress the mercury vapor pressure during high-temperature operation. In such a case, the output of the mercury discharge lamp is controlled in an optimal manner by fixing the position of the amalgam within the mercury discharge lamp to an optimal-temperature position (coldest position) (see, for example, Patent Literature 1).

Further, Non-patent Literature 1 discloses applying an electrical current and an ion current to an amalgam disposed within a mercury discharge lamp to thereby change the temperature of the amalgam or amalgam temperature.

PRIOR ART LITERATURE

Patent Literature 1: Japanese Patent Application Laid-open Publication No. 2009-266759

Non-patent Literature 1: "Control of Mercury Vapor Pressure of Fluorescent Lamps by Indium-Mercury Amalgam" by Hiroshi Washimi, Journal of the Illuminating Engineering Institute of Japan, Vol. 53, No. 8, pp. 442-449.

SUMMARY

Even in the case where the position of the amalgam within the mercury discharge lamp is fixed at the optimal temperature position as described in aforementioned Patent Literature 1, there arises the problem that optimal output cannot be obtained if so-called light adjustment is executed to, for example, decrease or increase optical output (visible light in the case of a fluorescent lamp or ultraviolet radiation in the case of an ultraviolet lamp), because the amalgam temperature changes in response to a change in the lamp power or wattage. With the technique described in aforementioned Non-patent Literature 1, on the other hand, although by applying the electrical current and ion current to the amalgam, the amalgam temperature can be changed and thus the mercury vapor pressure can be controlled, there arises the problem that the life of the lamp is considerably shortened because electrons and ions collide or run into the amalgam alloy and a binding substance of the amalgam with high kinetic energy to scatter such component materials.

In view of the foregoing prior art problems, it is one of the objects of the present invention to provide a mercury discharge lamp provided with a function for controlling amalgam temperature.

The mercury discharge lamp of the present invention includes: a discharge tube having encapsulated therein mercury in an amalgam form; and a temperature control member that controls an ambient temperature of the amalgam in such a manner as to compensate for a change in the ambient temperature of the amalgam.

In an embodiment of the present invention, the temperature control member includes a support member supporting the amalgam at a predetermined position, and the support member is formed or constituted by a bimetal. By the support member deforming in response to a change in the ambient temperature of the amalgam, the temperature control member changes a spaced-apart distance of the amalgam, supported by the support member, to a filament of the discharge tube and thereby changes an influence of an amount of heat generation by the filament on the amalgam.

In another embodiment of the present invention, the temperature control member includes, near the amalgam, a resistance element whose electrical resistance value changes in response to a temperature, and the temperature control member is constructed to control heat generation by an electric heat-generating member in response to a change in the electrical resistance value of the resistance element responsive to a temperature change.

For example, the temperature control member can raise the ambient temperature of the amalgam in such a manner as to compensate for a fall of a temperature of the discharge tube caused due to a fall of output during lighting of the lamp (namely, a fall of optical output at the time of light adjustment). In this way, it is possible to appropriately control the mercury vapor pressure even when the optical output has fallen due to the light adjustment.

DETAILED DESCRIPTION

Figure 1:
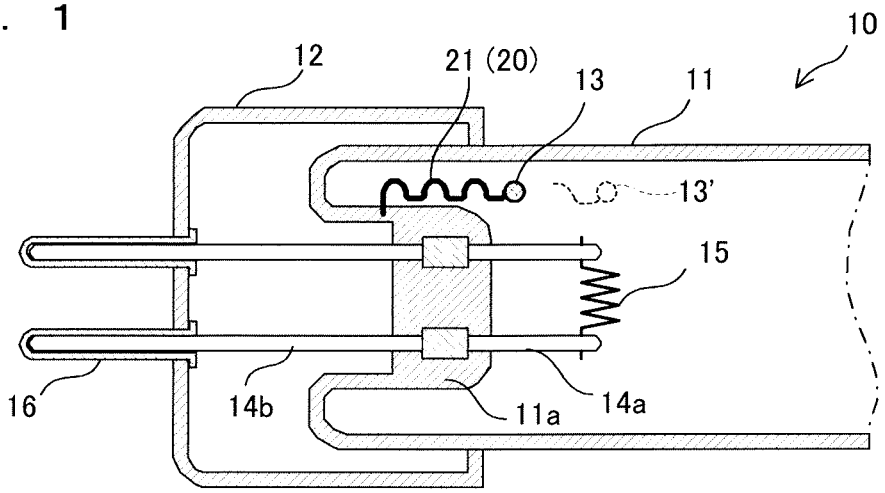
FIG. 1 is a schematic sectional view illustrating in an enlarged scale one end portion of a mercury discharge lamp according to an embodiment of the present invention.

FIG. 1 is a schematic sectional view illustrating in an enlarged scale one end portion of a mercury discharge lamp 10 according to an embodiment of the present invention. The mercury discharge lamp 10 includes a discharge tube 11 formed of quartz glass and having a mercury amalgam 13 encapsulated therein, and a base 12 provided on one end portion of the discharge tube 11. As an example, the discharge tube 11 is formed in a straight shape. As conventionally known in the art, one end portion of the discharge tube 11 is constructed as a stem section 11*a*, an inner lead 14*a* and an outer lead 14*b* are fixed to the stem section 11*a*, and a filament 15 is connected to the inner lead 14*a*. The outer lead 14*b* is connected to an electrical terminal 16 that is provided to project from the base 12. The inner lead 14*a* and the outer lead 14*b* are electrically connected with each other in such a manner that an electrical current supplied from a ballast (not shown) via the electrical terminal 16 is applied to the filament 15.

A temperature control member 20 that controls an ambient temperature of the amalgam 13 is provided within the discharge tube 11 in such a manner as to compensate for a change in the ambient temperature of the amalgam 13. In the embodiment illustrating in FIG. 1, the temperature control member 20 is constituted by a wave-shaped bimetal 21. Within the discharge tube 11, the bimetal 21 is fixed at one end to a suitable part (for example, to the stem section 11*a*), and the amalgam 13 is disposed at the other end (or free end) of the bimetal 21. The mercury discharge lamp 10, which is of a type capable of light adjustment control, radiates UV (ultraviolet ray) light of 100% output at rated lamp power and radiates UV light of less-than-100% output at lamp power less than the rated lamp power. A fixed position and a construction of the bimetal 21 are designed in such a manner that the amalgam 13 is located at such a position where optimal mercury vapor pressure is produced when the lamp output is 100%. Generally, an optimal position of the amalgam 13 is at or near a position where desired ultraviolet ray output within the discharge lamp 11 becomes maximum; in a specific example, such an optimal position of the amalgam 13 is at or near a position where the desired ultraviolet ray output within the discharge lamp 11 becomes about 100° C. For example, in a case where the amalgam 13 of In—Bi—Hg (Hg content is 5%) is used, an optimal mercury vapor temperature for radiating 185-nm ultraviolet rays is about 100° C. that corresponds to about 60° C. of pure mercury vapor pressure. Thus, the fixed position and the construction of the bimetal 21 are designed, for example, in such a manner that when the lamp output is 100%, the ambient temperature of the amalgam 13 becomes about 100° C.

In the embodiment of FIG. 1, the bimetal 21 functioning as the control member 20 expands or deforms in such a manner that its distal end, where the amalgam 13 is disposed, approaches or moves closer to the filament 15, as the ambient temperature of the amalgam 13 falls to less than the above-mentioned optimal temperature (for example, about 100° C.). In this case, the filament 15 functions as a heat source such that the ambient temperature of the amalgam 13 rises as the amalgam 13 approaches the filament 15, and as a result, the ambient temperature of the amalgam 13 can be maintained at or near the above-mentioned optimal temperature (for example, about 100° C.) or maintained in a temperature region that does not greatly deviate from the above-mentioned optimal temperature. Therefore, although the ambient temperature of the bimetal 21 falls when light adjustment control of the mercury discharge lamp 10 is executed so as to decrease the lamp output, or output light quantity of the lamp, to less than 100% during lighting of the lamp 10, namely, while the lamp 10 is ON, the distal end of the bimetal 21 moves closer to the filament 15 such that the amalgam 13 approaches the filament 15. Consequently, the ambient temperature of the amalgam 13 rises, and thus, the mercury vapor pressure can be maintained as optimal as possible. In FIG. 1, reference numeral 13' represents an example of the position of the amalgam 13 having approached the filament 15. Note that because it is generally common to preheat the filament 15 when the light adjustment control is executed on the mercury discharge lamp 10 in order to decrease the lamp output to less than 100%, the ambient temperature of the amalgam 13 having approached the filament 15 rises due to increased heat generated from the filament 15 as a result of a preheating current being added to a lamp current normally flowing through the filament 15.

The following consider a specific position and an amount of movement of the amalgam 13 for being heated. As an example, let it be assumed here that the discharge tube 11 has an outer diameter of 15 mm, a distance and a temperature difference between the position of the filament 15 and the coldest portion are 15 mm and 50° C., respectively, and a temperature change of the coldest portion per lamp wattage W is 0.35° C./W. In such a case, a temperature gradient between the position of the filament 15 and the coldest portion is about 3.3° C./mm. If the light adjustment is executed, for example, with 60 W lamp power less than the rated lamp power in a case where the rated lamp power is, for example, 150 W, it can be assumed that the temperature of the coldest portion decreases by about "0.35° C.×90=31.5° C." due to the lamp power fall of 90 W. Thus, in order to compensate for such a temperature decrease of about 31.5° C., it is enough to cause the amalgam 13, located in the coldest portion, to approach the filament 15 by a distance of "31.5÷ 3.3=about 9.5 mm". By thus causing the amalgam 13 to approach the filament 15 by about 9.5 mm, the ambient temperature of the amalgam 13 can be maintained at or near the above-mentioned optimal temperature (for example, about 100° C.) or in a temperature region not greatly deviating from the optimal temperature. Thus, it is enough to set characteristics of the bimetal 21 appropriately on the basis of the aforementioned considerations.

Figure 2:
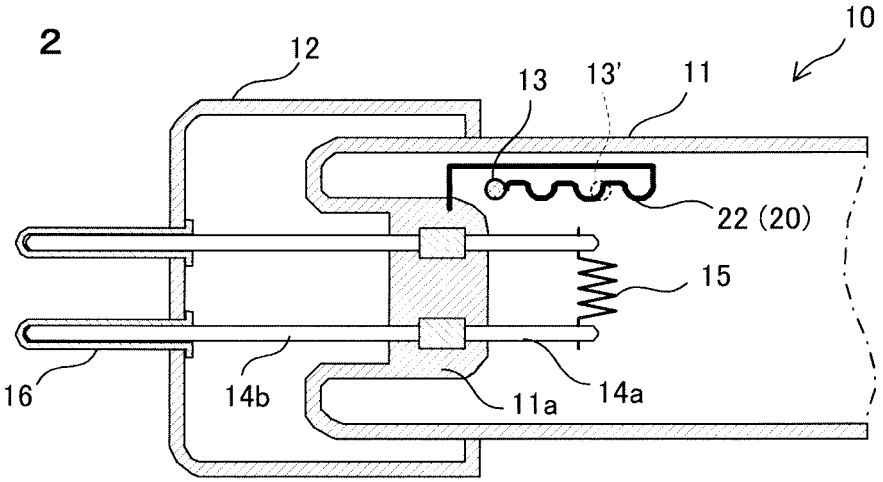
FIG. 2 is a schematic sectional view illustrating in an enlarged scale one end portion of a mercury discharge lamp according to another embodiment of the present invention.

FIG. 2 is a schematic sectional view illustrating one end portion of a mercury discharge lamp 10 according to another embodiment of the present invention. In this embodiment, a wave-shaped bimetal 22 as the temperature control member 20 has a characteristic of shrinking as the ambient temperature of the amalgam 13 falls to less than the above-mentioned optimal temperature (for example, about 100° C.), in contrast to the bimetal 21 illustrated in FIG. 1. Namely, this embodiment is constructed in such a manner that the distal end of the bimetal 22 having the amalgam 13 disposed thereon approaches the filament 15 by the shrinking of the bimetal 22. In FIG. 2 too, reference numeral 13' represents an example of a position of the amalgam 13 having approached the filament 15. In FIG. 2, although the ambient temperature of the bimetal 22 falls as the lamp adjustment control of the mercury discharge lamp 10 is executed so as to decrease the lamp output to less than 100% during lighting of the lamp 10, the bimetal 22 shrinks such that the amalgam 13 disposed on the distal end of the bimetal 22 approaches the filament 15 and thus the ambient temperature of the amalgam 13 rises, with the result that the mercury vapor pressure can be maintained as optimal as possible.

The embodiments of FIGS. 1 and 2 will be summarized below. The temperature control member 20 includes a support member supporting the amalgam 13 at a predetermined position, and the support member is formed or constituted by the bimetal 21 or 22. Such a support member deforms in response to a change in the ambient temperature of the amalgam 13 in such a manner that a spaced-apart distance of the amalgam 13, supported on the support member, to the filament 15 of the discharge tube 11 is changed and thus an influence of an amount of heat generation by the filament 15 on the amalgam 13 is changed. To further summarizing the embodiments of FIGS. 1 and 2, the support member (bimetal 21 or 22) is fixed at one end to a mounting base (stem section 11*a*) of the filament 15 within the discharge tube 11, and the amalgam 13 is disposed on a free end portion of the support member. More specifically, the support member (bimetal 21 or 22) is fixed at the one end to the mounting base (stem section 11*a*) of the filament 15 in such a manner that the free end of the support member approaches or moves away from the filament 15 as the support member (bimetal 21 or 22) deforms in response to a fall or a rise of the ambient temperature of the amalgam 13.

Figure 3:
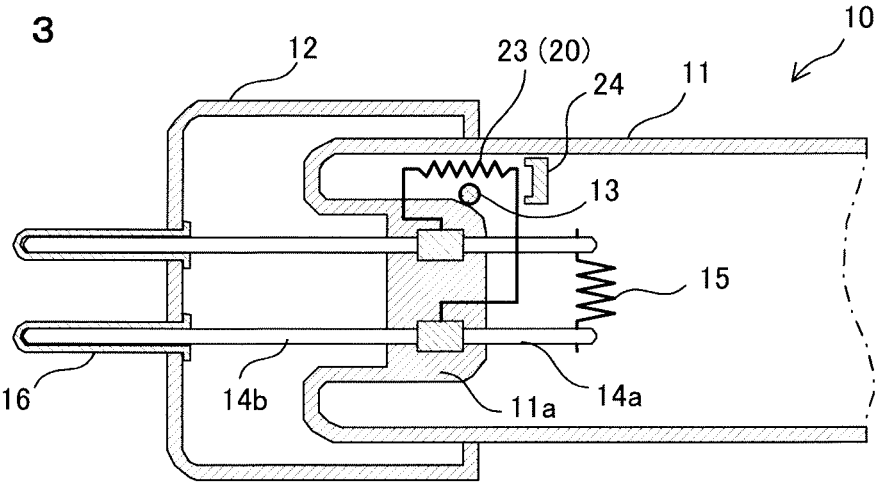
FIG. 3 is a schematic sectional view illustrating in an enlarged scale one end portion of a mercury discharge lamp according to still another embodiment of the present invention.

FIG. 3 is a schematic sectional view illustrating one end portion of a mercury discharge lamp 10 according to still another embodiment of the present invention. In this embodiment, a resistance element, such as a thermistor 23, whose electrical resistance value changes in response to a change in an environmental temperature, is used as the temperature control member 20. The amalgam 13 is disposed fixedly at a predetermined optimal position (coldest portion) within the discharge tube 11, and the resistance element, namely, thermistor 23, is disposed near the amalgam 13 within the discharge tube 11. The thermistor 23 is of a type whose electrical resistance value increases in response to a fall in the ambient temperature. When the ambient temperature of the amalgam 13 falls to less than the above-mentioned optimal temperature (for example, about 100° C.), the electrical resistance value of the thermistor 23 increases. In this embodiment, the thermistor 23 itself functions as an electric heat-generating member, and by the thermistor 23 generating heat in response to an increase in the electrical resistance value, the ambient temperature of the amalgam 13 rises, and consequently, the ambient temperature of the amalgam 13 is maintained in as possible an optimal temperature region as possible. Note that in the illustrated example of FIG. 3, the thermistor 23, which is an electric component part, is disposed within the discharge tube 11 and thus exposed to collisions of ions generated within the discharge tube 11. For this reason, it is preferable that a protection member (for example, protection tube) 24 for protecting the thermistor 23 from ion bombardment be provided at an appropriate position.

Figure 4:
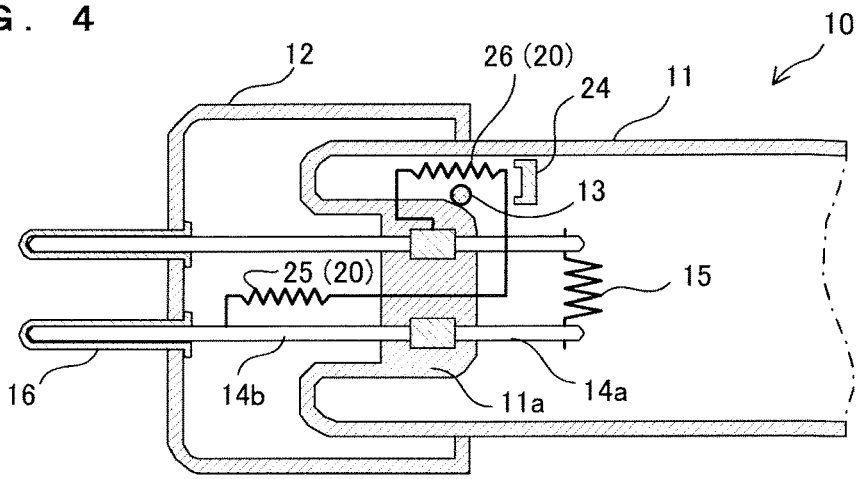
FIG. 4 is a schematic sectional view illustrating in an enlarged scale one end portion of a mercury discharge lamp according to still another embodiment of the present invention.

FIG. 4 is a schematic sectional view illustrating one end portion of a mercury discharge lamp 10 according to still another embodiment of the present invention, which more particularly illustrates is a modification of the embodiment illustrated in FIG. 3. In this embodiment, a resistance element, such as a thermistor 25, whose electrical resistance value changes in response to a change in the environmental temperature, and a heat-generating resistor (namely, electric heat-generating member) 26 are used in combination as the temperature control member 20. The heat-generating resistor 26 is disposed near the amalgam 13 within the discharge tube 11, similarly to the thermistor 23 illustrated in FIG. 3. On the other hand, the resistance element, namely, the thermistor 25, whose electrical resistance value changes in response to a change in the environmental temperature, is disposed within the base 12. Because ambient temperature within the base 12 changes in correspondence to a change in the ambient temperature of the amalgam 13 as the output of the mercury discharge lamp 10 is increased or decreased, the thermistor 25 is disposed within the base 12 at a position where the ambient temperature changes along with a change in the ambient temperature environment of the amalgam 13. Note that the thermistor 25 is of a type whose electrical resistance value decreases in response to a fall in the ambient temperature, and the thermistor 25 and the heat-generating resistor 26 are connected in series with each other. When the ambient temperature of the amalgam 13 is in the region of the above-mentioned optimal temperature (for example, about 100° C.), a necessary electrical current for generating heat does not flow through the series circuit of the thermistor 25 and heat-generating resistor 26, because the ambient temperature and resistance value of the thermistor 25 are also high. When the ambient temperature of the amalgam 13 falls to less than the above-mentioned optimal temperature (for example, about 100° C.), the ambient temperature and resistance value of the thermistor 25 too fall or decrease, the electrical current flowing through the series circuit of the thermistor 25 and heat-generating resistor 26 increases, and thus, the heat-generating resistor 26 generates heat such that the ambient temperature of the amalgam 13 rises. In this way, the ambient temperature of the amalgam 13 can be maintained in as possible an optimal temperature region as possible. As in the embodiment of FIG. 3, the protection member 24 for protecting the heat-generating resistor 26, which is an electric component part within the discharge tube 11, from ion bombardment is provided at an appropriate position. This embodiment achieves the advantageous benefit that the thermistor 25 is not exposed to collisions of ions generated within the discharge tube 11 because the thermistor 25 is provided within the base 12.

Figure 5:
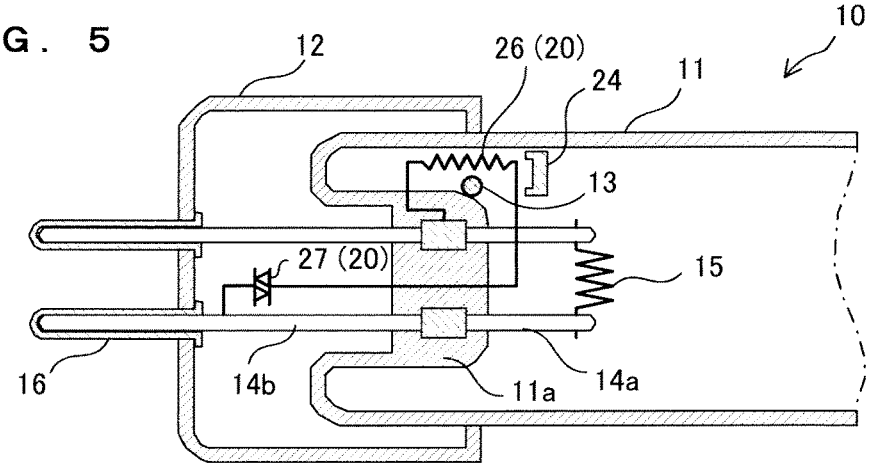
FIG. 5 is a schematic sectional view illustrating in an enlarged scale one end portion of a mercury discharge lamp according to still another embodiment of the present invention.

FIG. 5 is a schematic sectional view illustrating one end portion of a mercury discharge lamp 10 according to still another embodiment of the present invention, which more particularly illustrates a modification of the embodiment illustrated in FIG. 4. In the embodiment of FIG. 5, a DIAC (bi-directional Zener diode, namely, bi-directional constant voltage diode) 27 is disposed within the base 12 in place of the thermistor 25 of FIG. 4. The heat-generating resistor (namely, electric heat-generating member) 26 is disposed near the amalgam 13 within the discharge tube 11, as in the embodiment of FIG. 4. The DIAC 27 and the heat-generating resistor 26 are connected in series with each other, and this series circuit is connected in parallel to the filament 15. As in the embodiments of FIGS. 3 and 4, the protection member 24 for protecting the heat-generating resistor 26, which is an electric component part within the discharge tube 11, from ion bombardment is provided at an appropriate position. Further, in this embodiment, the DIAC 27 is not exposed to collisions of ions generated within the discharge tube 11 because the DIAC 27 is provided within the base 12, and thus, an extended life of the DIAC 27 can be ensured.

Now, operation of the embodiment illustrated in FIG. 5 will be described. When the mercury discharge lamp 10 is ON at the rated power, there is no, or very low, preheating voltage applied to the filament 15; thus, the DIAC 27 is kept OFF, and no electrical current flows through the heat-generating resistor 26. When the light adjustment control of the mercury discharge lamp 10 is executed to decrease the lamp output, the filament 15 is preheated. Thus, the DIAC 27 is tuned on, an electrical current flows through the heat-generating resistor 26 such that the resistor 26 generates heat, and consequently, the ambient temperature of the amalgam 13 rises. In this way, during the execution of the light adjustment control, the ambient temperature of the amalgam 13 can be maintained in as possible an optimal temperature region as possible.

Figure 6:
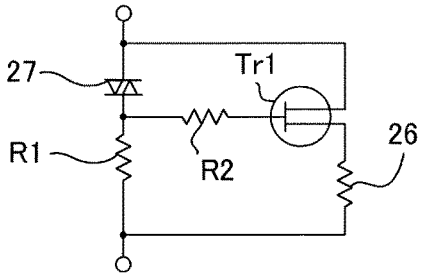
FIG. 6 is a circuit diagram illustrating a specific example of a temperature control circuit applicable to the embodiment of FIG. 5.

Note that because the Zener diode constituting the DIAC 27 is often of a type that operates with a relatively small electrical current, it is preferable that the current flowing through the DIAC 27 when the DIAC 27 is turned on be amplified as necessary by an amplifier circuit element, such as a transistor, to supply the heat-generating resistor 26 with an electrical current necessary for appropriately heating the resistor 26. FIG. 6 illustrates an example of such an amplifier circuit. In FIG. 6, the amplifier circuit includes a resistor R1 connected in series to the DIAC 27, a transistor Tr1, and a resistor R2 connected between a connection point between the DIAC 27 and the resistor R1 and the base of the transistor Tr1. The series circuit of the DIAC 27 and the resistor R1 is connected in parallel to the filament 15. Further, the heat-generating resistor 26 is connected to the emitter of the transistor Tr1, and a series circuit constituted by the collector of the transistor Tr1 and the heat-generating resistor 26 is connected in parallel to the filament 15. With such arrangements, the DIAC 27 is turned on in response to the preheating voltage applied to the filament 15 when the light adjustment control of the mercury discharge lamp 10 is executed so as to decrease the lamp output, so that the transistor Tr1 is turned on, an electrical current flows through the heat-generating resistor 26 such that the resistor 26 generates heat, and consequently, the ambient temperature of the amalgam 13 rises. In this way, during the execution of the light adjustment control, the ambient temperature of the amalgam 13 can be maintained in as possible an optimal temperature region as possible. Note that the resistors R1 and R2 and the transistor Tr1, which are amplifier circuit elements, are disposed within the base 12 and only the heat-generating resistor 26 is disposed within the discharge tube 11 as illustrated in FIG. 5. Because not only the DIAC 27 but also the amplifier circuit elements R1, R2, and Tr1 are disposed within the base 12 as noted above, these circuit elements are not exposed to collisions of ions generated within the discharge tube 11, and consequently, an extended life of these circuit elements can be ensured.

Figure 7:
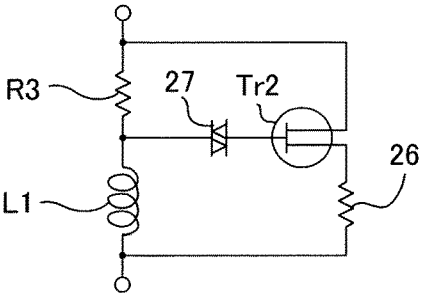
FIG. 7 is a circuit diagram illustrating another example of the temperature control circuit applicable to the embodiment of FIG. 5.

FIG. 7 illustrates another example of the amplifier circuit applicable to the embodiment of FIG. 5. In FIG. 7, this amplifier circuit includes a transistor Tr2 having one end of the DIAC 27 connected to the base thereof, and a series circuit of a resistor R3 and a choke coil L1. The series circuit of the resistor R3 and the choke coil L1 is connected in parallel to the filament 15. The DIAC 27 is inserted between a connection point between the resistor R3 and the choke coil L1 and the base of the transistor Tr2. Further, the heat-generating resistor 26 is connected to the emitter of the transistor Tr2, and a series circuit constituted by the collector of the transistor Tr2 and the heat-generating resistor 26 is connected in parallel to the filament 15. The amplifier circuit illustrated in FIG. 7 is applicable to a case in which is employed a system that raises a lighting frequency of the mercury discharge lamp 10 in order to preheat the filament 15. Namely, if the lighting frequency of the mercury discharge lamp 10 is raised in order to preheat the filament 15, impedance of the choke coil L1 increases, voltage applied to the DIAC 27 increases, the DIAC 27 is turned on, the transistor Tr2 is turned on, an electrical current flows through the heat-generating resistor 26 such that the heat-generating resistor 26 generates heat, and thus, the ambient temperature of the amalgam 13 rises. In this way, during execution of the light adjustment control, the ambient temperature of the amalgam 13 can be maintained in as possible an optimal temperature region as possible. In this case too, the DIAC 27 and the resistor R3, choke coil L1 and transistor Tr2, which are amplifier circuit elements, are disposed within the base 12, and only the heat-generating resistor 26 is disposed within the discharge tube 11 as illustrated in FIG. 5. Because not only the DIAC 27 but also the amplifier circuit elements R3, L1, and Tr2 are disposed within the base 12, these circuit elements are not exposed to collisions of ions generated within the discharge tube 11, and consequently, an extended life of these circuit elements can be ensured.

Note that in a case where the mercury discharge lamp 10 is of a type where the base 12 is provided on each of opposite end portions of the discharge tube 11 of a straight shape, the mercury amalgam 13 and the temperature control member 20 may be disposed on each of the opposite end portions of the discharge tube 11. The present invention is applicable to a mercury discharge lamp including a discharge tube of any other desired shape than a straight shape. Further, the present invention is applicable to any other types of mercury discharge lamps, such as a fluorescent lamp, than the ultraviolet-ray-radiating type of mercury discharge lamp.

The invention claimed is:

1. A mercury discharge lamp comprising:

a discharge tube having encapsulated therein mercury in an amalgam form; and a temperature control member that, in response to a change in an ambient temperature of the amalgam, controls the ambient temperature of the amalgam in such a manner as to compensate for the change in the ambient temperature of the amalgam, wherein the temperature control member includes a support member supporting the amalgam at a predetermined position, the support member being constituted by a bimetal having a wave-shaped portion that deforms in response to the change in the ambient temperature of the amalgam, the deformation of the wave-shaped portion of the bimetal causing the amalgam to move away from the predetermined position.

2. The mercury discharge lamp according to claim 1, wherein by the wave-shaped portion of the bimetal deforming in response to the change in the ambient temperature of the amalgam, the wave-shaped portion of the bimetal changes a spaced-apart distance of the amalgam, supported by the support member, to a filament of the discharge tube and thereby changes an influence of heat generation by the filament on the amalgam.

3. The mercury discharge lamp according to claim 2, wherein the support member is fixed at one end to a mounting base of the filament within the discharge tube and the amalgam is disposed on a free end portion of the wave-shaped portion of the bimetal in such a manner that the free end of the wave-shaped portion of the bimetal approaches or moves away from the filament as the wave-shaped portion of the bimetal deforms in response to a fall or a rise of the ambient temperature of the amalgam.

4. The mercury discharge lamp according to claim 1, wherein the temperature control member raises the ambient temperature of the amalgam in such a manner as to compensate for a temperature fall of the discharge tube caused due to a fall of output during lighting of the mercury discharge lamp.

5. A mercury discharge lamp comprising:

a discharge tube having encapsulated therein mercury in an amalgam form; and a temperature control member that controls an ambient temperature of the amalgam in such a manner as to compensate for a change in the ambient temperature of the amalgam, wherein the temperature control member includes an electric heat-generating member disposed near the amalgam within the discharge tube, and a circuit element that is disposed within a base of the mercury discharge lamp and supplies an electrical current to the electric heat-generating member so as to compensate for a fall of the ambient temperature of the amalgam, and wherein the circuit element includes a first circuit element that operates in response to an increase in voltage supplied to the filament of the discharge tube, and a second circuit element that supplies an electrical current to the electric heat-generating member in response to operation of the first circuit element.

6. The mercury discharge lamp according to claim 5, wherein the first circuit element includes a constant voltage diode, and the second circuit element includes an amplifier circuit element that amplifies output of the constant voltage diode.

7. A mercury discharge lamp comprising:

a discharge tube having encapsulated therein mercury in an amalgam form; and a thermistor disposed so as to be spaced apart from the amalgam and being configured to control, in response to a change in an ambient temperature of the amalgam, the ambient temperature of the amalgam in such a manner as to compensate for the change in the ambient temperature of the amalgam.

8. The mercury discharge lamp according to claim 7, wherein an electrical resistance value of the thermistor changes in response to the change in the ambient temperature of the amalgam.

9. The mercury discharge lamp according to claim 8, wherein the thermistor is disposed in the discharge tube, and the electrical resistance value of the thermistor increases in response to a fall of the ambient temperature of the amalgam.

10. The mercury discharge lamp according to claim 8, wherein the thermistor is disposed outside the discharge tube and within a base of the mercury discharge lamp, and the electrical resistance value of the thermistor decreases in response to a fall of the ambient temperature of the amalgam.

11. The mercury discharge lamp according to claim 10, further comprising an electric heat-generating member disposed spaced apart from the amalgam and within the discharge tube, wherein the thermistor disposed within the base of the mercury discharge lamp is configured to supply an electrical current to the electric heat-generating member so as to compensate for the fall of the ambient temperature of the amalgam.

12. The mercury discharge lamp according to claim 11, wherein the electric heat-generating member is a heat generating resistor connected in series with the thermistor.

* * * * *